US012577730B2

(12) United States Patent
Rührnössl et al.

(10) Patent No.: US 12,577,730 B2
(45) Date of Patent: Mar. 17, 2026

(54) ANTISTATIC COVER-CORE-ROPE

(71) Applicant: TEUFELBERGER FIBER ROPE GMBH, Wels (AT)

(72) Inventors: Erich Rührnössl, Haid (AT); Björn Ernst, Gmunden (AT); Susanna Schiemer, Linz (AT); Roland Dornetshuber, Tollet (AT)

(73) Assignee: TEUFELBERGER FIBER ROPE GMBH, Wels (AT)

( * ) Notice: Subject to any disclaimer, the term of this patent is extended or adjusted under 35 U.S.C. 154(b) by 122 days.

(21) Appl. No.: 18/244,501

(22) Filed: Sep. 11, 2023

(65) Prior Publication Data

US 2024/0084505 A1 Mar. 14, 2024

(30) Foreign Application Priority Data

Sep. 9, 2022 (EP) ..... 22194821

(51) Int. Cl.
*D07B 1/02* (2006.01)
*D07B 1/16* (2006.01)

(52) U.S. Cl.
CPC ..... *D07B 1/025* (2013.01); *D07B 1/162* (2013.01); *D07B 2201/104* (2013.01);
(Continued)

(58) Field of Classification Search
CPC ..... D07B 1/005; D07B 1/025; D07B 1/147; D07B 1/16; D07B 2201/1096;
(Continued)

(56) References Cited

U.S. PATENT DOCUMENTS 3,422,460 A * 1/1969 Burke ..... A41D 31/26 2/73
3,590,570 A * 7/1971 Okuhashi ..... D02G 3/441 57/903

(Continued)

FOREIGN PATENT DOCUMENTS

CN 202187237 U * 4/2012
EP 2434050 A1 3/2012
EP 3392404 A1 10/2018

OTHER PUBLICATIONS

Translation of CN 202187237.*

(Continued)

*Primary Examiner* — Shaun R Hurley
(74) *Attorney, Agent, or Firm* — Workman Nydegger

(57) ABSTRACT

The invention refers to a rope (3) made of a textile fiber material, comprising a rope core (6) and a sheath (7) surrounding the rope core (6), wherein the rope (3) comprises at least one antistatic multifilament yarn (5) or antistatic monofilament that is located in the rope core (6), in the sheath (7), in an intermediate sheath (8) located between the rope core (6) and the sheath (7) and/or in a reinforcement located between the rope core (6) and the sheath (7), wherein the antistatic monofilament or individual filaments (12) of the antistatic multifilament yarn (5) each comprise a conductive fiber core (13) sheathed with a non-conductive plastic sheath (14), and the at least one antistatic multifilament yarn (5) or antistatic monofilament is twisted with a twine (16) or yarn of a different material, wherein the other material of the twine (16) or yarn is preferably UHMWPE or PES.

18 Claims, 4 Drawing Sheets

(52) U.S. Cl.
CPC ..... *D07B 2201/1096* (2013.01); *D07B 2201/2002* (2013.01); *D07B 2201/2009* (2013.01); *D07B 2201/2012* (2013.01); *D07B 2201/209* (2013.01); *D07B 2201/2095* (2013.01); *D07B 2205/2003* (2013.01); *D07B 2205/201* (2013.01); *D07B 2501/2015* (2013.01)

(58) Field of Classification Search
CPC ..... D07B 2201/209; D07B 2201/2095; D07B 1/162; D02G 3/441
See application file for complete search history.

(56) References Cited

U.S. PATENT DOCUMENTS 3,882,667 A * 5/1975 Barry ..... D02G 3/441 57/244
4,216,264 A * 8/1980 Naruse ..... D01F 8/04 428/397
4,420,534 A * 12/1983 Matsui ..... D01D 5/30 428/397
4,606,968 A * 8/1986 Thornton ..... H05K 9/0079 442/187
5,062,161 A * 11/1991 Sutton ..... D02G 3/442 66/174
5,071,699 A * 12/1991 Pappas ..... D03D 15/533 383/117
5,102,727 A * 4/1992 Pittman ..... D03D 15/49 442/187
5,202,185 A * 4/1993 Samuelson ..... D01F 1/09 428/397
5,478,154 A * 12/1995 Pappas ..... D06M 15/227 383/113
5,927,060 A * 7/1999 Watson ..... D02G 3/12 57/212
6,675,838 B2 * 1/2004 Arthurs ..... D03D 1/0058 383/117
7,115,311 B2 * 10/2006 Arthurs ..... D03D 15/533 428/36.1
10,829,870 B2 * 11/2020 Carlsson ..... D02G 3/12
2012/0060963 A1 * 3/2012 Song ..... D04B 1/16 57/212
2015/0252499 A1 * 9/2015 Lipscomb ..... D03D 15/533 428/221
2018/0023221 A1 * 1/2018 Smeets ..... D06M 10/025 442/377
2018/0305865 A1 10/2018 Baldinger et al.
2019/0301089 A1 * 10/2019 De Sousa Faria ..... D07B 1/025
2019/0344629 A1 * 11/2019 Verstraeten ..... D02G 3/36
2020/0130432 A1 * 4/2020 Lee ..... B60C 19/082
2021/0277544 A1 * 9/2021 King ..... D02G 3/12
2021/0348309 A1 * 11/2021 Feibus ..... D04B 21/16

OTHER PUBLICATIONS

Anonymous, "static control with nega-stat®," Retrieved from https://www.barnet.com/products/nega-stat/, Retrieved on Jun. 20, 2022, pp. 20.
European Search Report received for EP Patent Application No. 22194821.9, mailed on Feb. 24, 2023, 08 pages.

* cited by examiner

ANTISTATIC COVER-CORE-ROPE

BACKGROUND OF THE INVENTION

The invention relates to a rope made of a textile fiber material and comprising a rope core as well as a sheath surrounding the rope core.

From the state of the art, in particular for use in the field of rope cranes, cover-core-ropes made of a textile fiber material are known, which are usually not electrically conductive. Such a rope is, e.g., shown in EP 3 392 404 A1. Since these ropes can usually not be grounded or discharged, there is, depending on the application case, static electricity on the rope surface, as will be described below.

In general, static electricity, i.e., electrostatic charging, occurs when two surfaces are separated. This may for example occur in moving ropes running over pulleys during operation. During operation, sections of the rope are thus in contact with pulleys mounted in the rope drive. These rope increments are redirected around the pulleys and after the desired change of direction in the rope drive, the rope moves off the pulley, i.e., the rope is separated from the pulley. By separating the surface of the rope from the surface of the pulley, both surfaces are charged with electric charge. If the pulley was sufficiently electrically conductive and grounded, the electric charge generated by separating the surfaces could be discharged into the ground, e.g., through the steel construction of the hoist device. Vice versa, the pulley could thus also ground the rope.

However, if there is no possibility of grounding the pulley, for example in the case of a crane in the bottom block with a load hook, the charge generated by separating the surfaces cannot be discharged. Consequently, electric charge is accumulated in the pulley, in the bottom block and in the load hook during operation due to continuous separation of the rope surface from the pulley surface. Discharge occurs spontaneously into the ground during contact of the rope, pulley, bottom block or load hook with an external conductor, e.g., when a person or an object gets into contact with this component. Thus, electric discharge can cause an electrostatic shock or startle persons, which may lead to consequential injuries, cause fire discharge and/or industrial explosions and/or cause damages in sensitive electronic devices.

Humans feel electrostatic charge starting from approximately 3 kV, which often leads to a moment of shock associated with a risk of accidents. The type and amount of accumulated charge depends on the material pairing of the two components, the component surfaces of the two components, the number of surface separations, and on all parameters influencing charge migration, in particular environmental temperature, component temperature, and air and surface humidity.

In case the use of electrically non-conductive materials (which are components with an ohmic resistance $>10^6$ ohm) in the components is necessary due to construction reasons, as is usually the case with the fiber ropes mentioned, electric charge occurring during operation must thus be discharged by at least one of the two components in order to avoid the dangers described above.

For fiber ropes, it is known from the disclosures WO2012042576A1 and JPH01207483A to provide ropes with antistatic properties. However, short antistatic fibers in the form of electrically conductive staple fibers are used, which are spun into a yarn. According to WO2012042576A1, the conductive staple fibers should be as short as possible in order to enable a so-called corona discharge. The ends of the staple fibers would act as electrodes to achieve a corona discharge. According to this principle, the larger the number of ends of staple fibers, the better a corona discharge would be. In many application cases, however, the rope described in WO2012042576A1 is not suitable, firstly because the staple fibers can easily move out of the yarn so that the rope is not suitable for longer periods of use. In addition, yarns manufactured specifically with staple fibers are too thick to be used in core-cover-constructions without changing the rope structure.

From the field of application of planar textiles it is known to use an antistatic fiber comprising a multilobal conductive fiber core covered by a non-conductive plastic sheath. Such fibers are known from U.S. Pat. No. 5,202,185 and are, for example, sold under the trademark Nega-Stat® P190 and arranged as a grid in planar woven, knitted or nonwoven fabrics, for example for manufacturing protective equipment. From the Internet presence of the company Barnet it is also known to use Nega-Stat® fibers in ropes. Furthermore, U.S. Pat. No. 5,202,185 teaches that individual ones of these fibers can be used as staple fibers. However, antistatic fibers can also comprise a fiber core that is not multilobal but, for example, circular, such as described in U.S. Pat. No. 3,803,453 A.

Document EP 2 434 050 A1 discloses a rope with a sensor module, which has an electrically conductive core and is coated with an electrically non-conductive coating. The sensor module is used to detect wear of the rope.

It is the object of the invention to provide an antistatic cover-core-rope made of a textile fiber material that overcomes the disadvantages of the state of the art.

SUMMARY OF THE INVENTION

This object is achieved by a rope made of a textile fiber material comprising a rope core as well as a sheath surrounding the rope core, the rope comprising at least one antistatic multifilament yarn or an antistatic monofilament provided in the rope core, in the sheath, in an intermediate sheath located between the rope core and the sheath, and/or in a reinforcement located between the rope core and the sheath, wherein the antistatic monofilament or individual filaments of the antistatic multifilament yarn each comprise a conductive fiber core sheathed with a non-conductive plastic coating.

According to the invention, at least one antistatic multifilament yarn or at least one antistatic monofilament is thus arranged in the rope in order to provide it with the antistatic properties. Contrary to the state of the art, no staple fibers are used, but a monofilament or a multifilament yarn, i.e., a continuous filament or continuous filament yarn, that can be provided parallel with or in an angle to the longitudinal axis of the rope. Since such a multifilament yarn or monofilament is much thinner than a yarn made of antistatic staple fibers, the multifilament yarn or the monofilament can be used more flexibly. Furthermore, it has the advantage compared to staple fibers that the multifilament yarns or monofilaments, due to their length, cannot be worked out of the rope, which provides a longer lifetime. Consequently, it is now possible to manufacture antistatic ropes for fields of application where thicker yarns with staple fibers cannot be used.

The antistatic monofilament or the antistatic multifilament yarn consisting of individual filaments with a conductive fiber core has, as is known, the property of attracting the electric field from the surface and can neutralize all of the free charge on the surface of the rope by corona discharge. In other words, the surface charges are attracted on the rope and dissipated to the environment via air ionization over time. Thereby, the surface discharge of the rope and of the pulley can be reduced to a level non-hazardous for humans and the environment. For a proof of efficacy reference is made to U.S. Pat. Nos. 5,202,185, 3,803,453 A, and the fiber sold by Barnet under the trademark Nega-Stat® P190.

In simple cases, the fiber core of the antistatic monofilament or the fiber core of the individual filaments of the antistatic multifilament yarn can have a circular shape in cross-section, as is, for example, known from U.S. Pat. No. 3,803,453 A. However, it is preferred that the fiber core of the antistatic monofilament or the fiber core of the individual filaments of the antistatic multifilament yarn has a multilobal shape in cross section, as known from U.S. Pat. No. 5,202,185, since these antistatic fibers have a better antistatic effect. In general, it is preferred that the fiber core of the antistatic monofilament or the fiber core of the individual filaments of the antistatic multifilament yarn is non-metallic. Furthermore, it is preferred that the fiber core comprises electrically conductive carbon black, also referred to as ECCB. The antistatic multifilament yarns and/or the antistatic monofilaments preferably have a maximum titer of 500 dtex.

In particular, the antistatic multifilament yarns or the antistatic monofilaments also have the advantage that they can be systematically worked into the components of the cover-core-rope, optionally only into the sheath, only into the core, only into the intermediate sheath, or only into the reinforcement. Thus, the amount of antistatic fibers can be reduced, which reduces costs and also saves weight.

Since the antistatic multifilament yarns or the antistatic monofilaments are often too thin to be used as a separate yarn on the bobbin of a round braiding machine, the antistatic multifilament yarns and/or antistatic monofilaments are twisted with a twine or yarn made of a different material, the other material mentioned preferably being UHMWPE or PES. This is particularly advantageous because the antistatic multifilament yarns or antistatic monofilaments are reinforced by the additional twine or yarn. Thus, there is less breaking of the antistatic multifilament yarns or antistatic monofilaments during use of the rope so that the antistatic properties of the rope are maintained for a longer time.

It is also advantageous that the antistatic multifilament yarns or antistatic monofilaments can be twisted directly with the "actual" material of the sheath or the rope core. The selected antistatic material can thus be so thin that the "actual" material does not have to be reduced, but the antistatic material can be added. Consequently, none of the favorable properties resulting from the "actual" material are lost, but the antistatic property is added. Specifically, the antistatic multifilament yarns or antistatic monofilaments do not have to be processed into staple fibers in order to introduce them into the rope.

Twisting the antistatic multifilament yarns or antistatic monofilaments with a twine or yarn made of a different material results in an "antistatic twine." The weight proportion of the antistatic multifilament yarns and/or antistatic monofilaments in the "antistatic twine" can, for example, be 3% to 20%, preferably 5% to 15%.

Particularly preferably the sheath and/or the intermediate sheath and/or the reinforcement, i.e., at least one of these components, is a braided structure with braids running in an S direction and a Z direction, wherein at least one braid running in an S direction comprises at least one first antistatic multifilament yarn or at least one first antistatic monofilament, and at least one braid running in a Z direction comprises at least one second antistatic multifilament yarn or one second antistatic monofilament. Here, the antistatic multifilament yarns or antistatic monofilaments run substantially parallel to the respective braid, apart from a twist caused by optional twisting, and thus form a cylindrical grid. Such an arrangement allows a particularly regular arrangement of the antistatic multifilament yarns or antistatic monofilaments in or under the rope surface, so that electrostatic charge can be particularly effectively received by the fibers and dissipated to the air.

In a further embodiment, the sheath and/or the intermediate sheath and/or the reinforcement is a braided structure with braids running in an S direction and a Z direction, where one or more antistatic multifilament yarns or antistatic monofilaments are present either only in one or more braids running in an S direction or only in one or more braids running in a Z direction. Thereby, the amount of antistatic multifilament yarns or antistatic monofilaments can be reduced. Consequently, in one case even only one single antistatic multifilament yarn or antistatic monofilament can be present in the rope. Here, the at least one antistatic multifilament yarn or the at least one antistatic monofilament runs helically around the rope direction on or under the rope surface and substantially in equal distances around the rope.

In order to further reduce the amount of antistatic multifilament yarns or antistatic monofilaments, they may be arranged in only some of the braids running in an S direction and/or Z direction, e.g., only in every second, every third, or every fourth braid running in the S direction and/or Z direction. This still provides the above structure but with larger mesh widths.

In braided structures comprising braids with at least two substantially parallel twines or plied yarns (which may, for example, be achieved by winding the twines or yarns onto the bobbin of a round braiding machine next to each other), the amount of antistatic multifilament yarns or antistatic monofilaments can furthermore be specifically selected when only some, preferably only one, of these twines or yarns of a braid comprise at least one antistatic multifilament yarn or antistatic monofilament. The other twines or yarns can thus be free of antistatic multifilament yarns and antistatic monofilaments.

Through the measures mentioned, the proportion of antistatic multifilament yarns or the proportion of antistatic monofilaments of the total titer of the sheath or the intermediate sheath can be adapted. Preferably, the proportion of the antistatic multifilament yarns or antistatic monofilaments of the total titer of the sheath or intermediate sheath is max. 25%, max. 10% or max. 5%. Furthermore, the proportion of the antistatic multifilament yarns or the proportion of the antistatic monofilaments of the total titer of the sheath or the intermediate sheath is at least 0.5%, at least 1%, at least 1.4%, at least 2.1% or at least 3% or substantially 1.4%, substantially 2.1% or substantially 3%. The titer or the total titer is calculated as mass/length and has the unit dtex when the mass is given in grams and the length is given in 10,000 meters. Experiments have shown that these proportions are also sufficient for ropes with long lifetimes in order to achieve excellent antistatic effects over the entire lifetime. In case of a reinforcement, the proportion of the antistatic multifilament yarns or the proportion of the antistatic monofilaments of the total titer of the reinforcement can also amount up to 100% because the reinforcement does not fully cover the surface. In case of the rope core, the proportion of the antistatic multifilament yarns or the proportion of the antistatic monofilaments can be chosen freely depending on the antistatic effect to be achieved and the desired mechanical properties of the rope core.

Irrespective of whether the antistatic multifilament yarns or antistatic monofilaments are present in the rope core, in the sheath, in the intermediate sheath, or in the reinforcement, it is preferred that the proportion of the antistatic multifilament yarns or antistatic monofilaments in the rope is selected so that after an electrostatic charging event, an electrostatic charge of the rope of 8 kV, preferably 5 kV, especially 3 kV, especially 2 kV, is not exceeded, measured at a temperature between 15° C. and 25° C. at a humidity between 30% and 40% at a distance of 10 cm from the rope. The electrostatic charge can, for example, be measured 10 seconds after an electrostatic charging event. The electrostatic charging event can, for example, be one or more lifting processes or other friction at the rope. The electrostatic charging event can, for example, be continued until a maximum electrostatic charge is reached. The mentioned electrostatic charge of the rope should not be exceeded, at least directly after the rope is manufactured, preferably also after predetermined wear of the rope, particularly at the end of the lifetime of the rope according to Chap. 6.3.3. (multilayer spooling performance) of ISO TS 23624:2021.

A person skilled in the art can easily determine the mentioned proportion based on these data. First, the rope is provided and electrostatically charged, for example by a predetermined number of lifting and lowering cycles without payload, e.g., after one or five lifting and lowering cycles without payload. If the electrostatic charge of the rope exceeds the mentioned electrostatic charge, the proportion of antistatic multifilament yarns or antistatic monofilaments in the rope is increased until the mentioned electrostatic charge is not exceeded anymore. If it is to be achieved that the mentioned electrostatic charge of the rope is also not exceeded at the end of the lifetime of the rope according to Chap. 6.3.3. of ISO TS 23624:2021 or after a certain wear relative to this lifetime (e.g., at 75% lifetime), the predetermined wear is first induced and then the electrostatic charge after an electrostatic charging event is determined. Here, it is suitable to electrostatically charge the rope with the same method that was used to achieve the wear, e.g., according to the mentioned standard, however, without using any payload for achieving the electrostatic charge.

Alternatively or in addition to antistatic multifilament yarns or antistatic monofilaments in the sheath, they may also be present in the rope core itself. If it comprises several core layers, which may in particular be the case with multilayer twisted cores, the at least one antistatic multifilament yarn or at least one antistatic monofilament is preferably only arranged in the outermost core layer because it is closest to the rope surface where the electrostatic charge is created during the separation of surfaces. In other cases, however, the rope core may also be braided.

If the at least one antistatic multifilament yarn or at least one antistatic monofilament is to be arranged in the reinforcement, it can be provided that the reinforcement is made solely of antistatic multifilament yarns or antistatic monofilaments. The reinforcement can be implemented in the form of stationary threads or alternatively as non-covering braided structure in order to form a grid-shaped mesh.

In order to achieve a distribution of antistatic multifilament yarns or antistatic monofilaments on or under the rope surface as even as possible, the antistatic multifilament yarns or antistatic monofilaments preferably form a regular cylindrical grid, the mesh width of which is preferably between 5 mm and 20 mm, particularly substantially 10 mm. In other cases, an unregular cylindrical grid could be provided, e.g., when antistatic multifilament yarns or antistatic monofilaments are arranged with different distances in the S direction and the Z direction. When antistatic multifilament yarns or antistatic monofilaments are present only as braids in the S direction and the Z direction, there is usually no grid but a helical covering.

Generally, the at least one antistatic multifilament yarn comprises at least six individual filaments, preferably exactly twenty-four individual filaments. Such multifilament yarns are already available on the market so that no further modifications have to be made.

In order to be able to also retrofit existing ropes it can in particular be provided that the sheath is constructed of a fully covering sheath layer and a reinforcement surrounding the covering sheath layer, with only the surrounding reinforcement comprising the at least one antistatic multifilament yarn or the at least one antistatic monofilament. In this manner, it is possible to use an existing rope and to braid or knit the reinforcement around the covering sheath layer of the rope, which creates a new two-part sheath which comprises the covering sheath layer of the existing rope on the one hand, and the retroactively braided reinforcement on the other hand. The mentioned two-part sheath can, however, also be made when a rope is newly manufactured. In particular, such a rope with a two-part sheath can be easily repaired. For example, if it is measured that the antistatic properties of the rope are not satisfactory anymore, the reinforcement can be removed and a new reinforcement may be braided thereon.

In a preferred embodiment, the rope core comprises high-strength fibers, preferably p-aramid fibers, m-aramid fibers, LCP fibers, UHMWPE fibers, or PBO fibers. Ropes with such rope cores can, in particular, be used for rope cranes.

Furthermore, it is preferred that the sheath and/or the intermediate sheath and/or the reinforcement comprises high-strength fibers, preferably p-aramid fibers, m-aramid fibers, LCP fibers, UHMWPE fibers, or PBO fibers, as well as non-high-strength fibers, preferably PA fibers, PES fibers, or PP fiber, wherein preferably at least one antistatic multifilament yarn or at least one antistatic monofilament is twisted into a first twine with the high-strength fibers, and at least one second antistatic multifilament yarn or one second antistatic monofilament is twisted into a second twine with the non-high-strength fibers. Such a sheath is particularly suitable for use in rope cranes.

The rope described above is particularly suitable for use as a crane rope, wherein the crane rope preferably carries a bottom block with a load hook for transporting, lifting and lowering loads. As described at the beginning, such structures are particularly prone to electrostatic charge because the bottom block cannot be grounded without additional measures. The inventive use, however, allows a reduction of the electrostatic charge to a hazard-free level, preferably below the human perception limit of 3 kV.

BRIEF DESCRIPTION OF THE DRAWINGS

Advantageous and non-limiting embodiments of the invention will be described in more detail below with reference to the drawings.

DETAILED DESCRIPTION OF THE DRAWINGS

Figure 1:
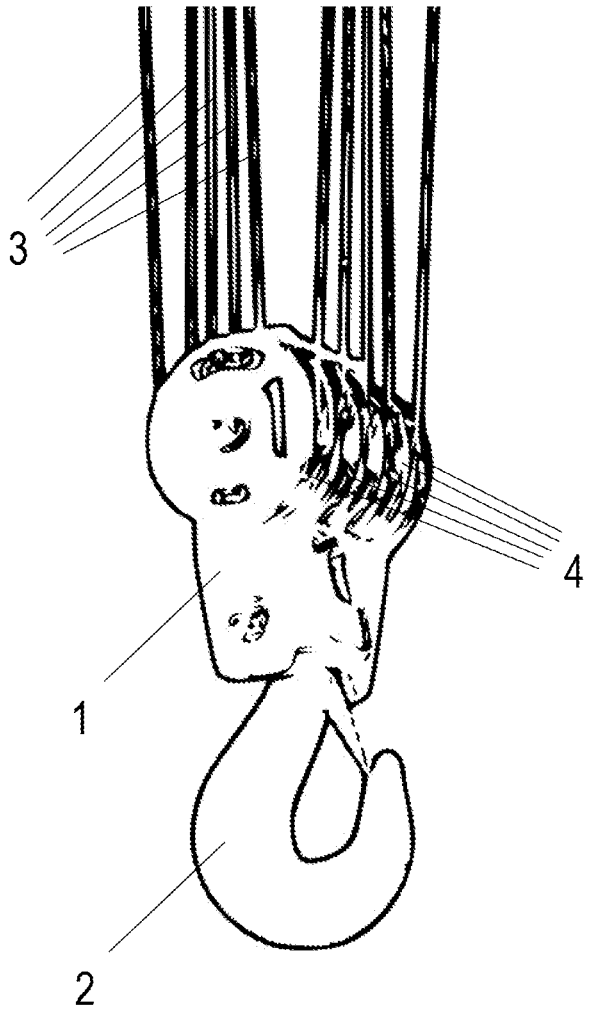
FIG. 1 shows a bottom block of a crane with a load hook using an inventive antistatic rope.

FIG. 1 shows a bottom block 1 with a load hook 2 of a crane not shown in further detail. In the shown embodiment, the bottom block 1 is carried by a 5-fold reeved rope 3 (10-stranded reeving), each of which is redirected around a pulley 4 of the bottom block 1. In other embodiments, the bottom block 1 could, however, be carried by a 1-fold reeved rope (2-stranded reeving), in which case the bottom block 1 comprises only one pulley 4.

The inventive rope 3 is a fiber rope, i.e., a rope 3 made of a textile fiber material with a usually substantially non-conductive rope surface. Herein, "non-conductive" refers to an ohmic resistance of $>10^6$ ohm. The section of the rope 3 that comes into contact with the respective pulley 4 is therefore not effectively grounded. From FIG. 1 it can be seen that the pulley 4 or the bottom block 1, respectively, is also not grounded because it is hanging freely in the air. If the rope would be used according to the state of the art as a pure fiber rope without any further measures for reducing the antistatic effect, the up and down movement of the bottom block 1 on the rope 3 during the operation of the rope crane would result in electrostatic charging of the rope 3 and the bottom block 1. In order to prevent electrostatic charging, the rope 3 has, as explained in detail below, at least one antistatic multifilament yarn 5 or an antistatic monofilament.

It should be mentioned, however, that the rope 3 described herein is not limited to application purposes as shown in FIG. 1 and does not have to be a crane rope. Generally, the rope 3 can be used for any application purpose where electrostatic charge is to be reduced. Usually, inventive ropes 3 have an exterior diameter of 5 mm to 60 mm.

Figure 2:
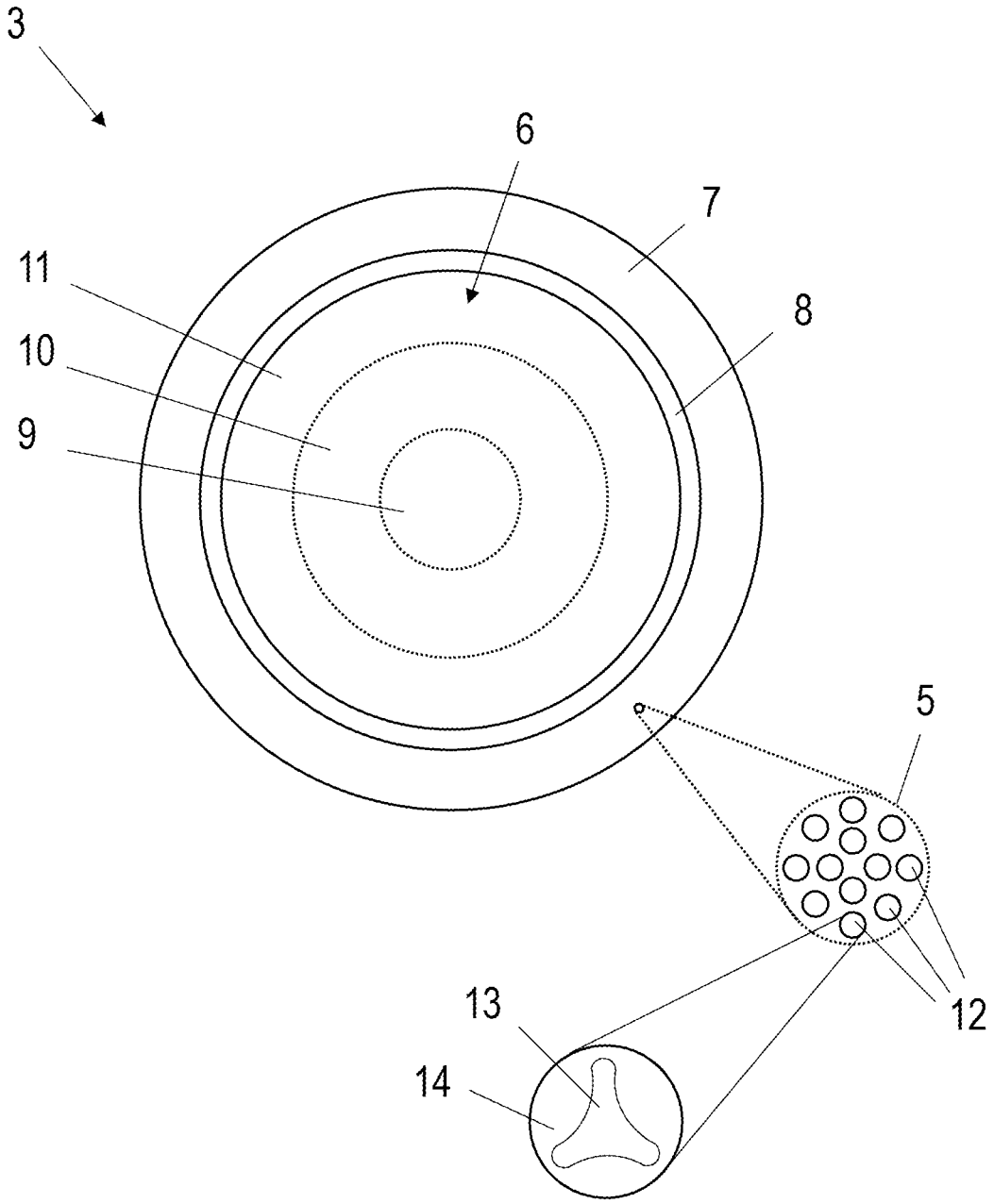
FIG. 2 shows a schematic cross-section of the inventive rope.

One variation of the structure of the inventive rope 3 is shown in FIG. 2, which represents a cross-section of a rope 3. The rope 3 comprises a rope core 6 and a sheath 7 surrounding the rope core 6. The rope 3 is made of a textile fiber material, i.e., the rope core 6 as well as the sheath 7 are made of a textile fiber material. Preferably, the rope 3 is manufactured free of metal, optionally apart from connecting elements or clamps that are mounted at the ends of the rope 3 or at a different position on the rope 3, or functional, electrically conductive wires that optionally run through the rope 3 and serve, for example, as electricity conductors, information conductors or sensors.

Optionally, the rope 3 may have an intermediate sheath 8 that is provided between the rope core 6 and the sheath 7. Depending on the respective embodiment, this intermediate sheath 8 may also be manufactured of a textile fiber material and preferably be formed metal-free. Alternatively or in addition to the intermediate sheath 8, a textile, preferably metal-free reinforcement (not shown) may be used, which refers to a non-covering component such as a mesh or stationary threads. If the reinforcement is used in combination with a covering intermediate sheath 8, the reinforcement can either be between the rope core 6 and the intermediate sheath 8 or between the intermediate sheath 8 and the sheath 7.

As can be further seen from FIG. 2, the rope core 6 has several core layers 9, 10, 11, with the core layer arranged closest to the sheath 7 being referred to as the outermost core layer 11. In practice, a multilayer rope core 6 can, for example, be manufactured when the rope core 6 is manufactured by multilayer twisting of strands. In the shown embodiment, the rope core 6 comprises three core layers 9, 10 11, however, it is also possible to use only two or more than three core layers, and the individual strand layers can have different lay directions around the longitudinal axis. In other variations, however, the rope core 6 could also be implemented without any core layers or be formed by several strands that do not form layers or be braided.

In order to reduce the electrostatic charge of the rope 3 during the operation of the rope 3, the rope 3 comprises at least one antistatic multifilament yarn 5 or at least one antistatic monofilament. The antistatic multifilament yarn 5 or the antistatic monofilament or the antistatic multifilament yarns 5 or the antistatic monofilaments is/are present as continuous fibers over substantially the entire length of the rope 3. In technical jargon, filaments or continuous fibers refer to fibers with a length of >1000 mm. Optionally, there might be breaking points in or more antistatic filaments after use, wherein these damaged antistatic filaments can still be referred to as continuous fibers. Multifilament yarns consist of a defined number of individual filaments and are only available in this form and not in a separated form. Monofilaments are individual filaments with a generally larger thickness that are available in this separated form.

The antistatic multifilament yarn 5 consists of several individual filaments 12 that are substantially parallel and run directly next to each other in order to form the corresponding antistatic multifilament yarn 5. The individual filaments 12 are usually present in a loose form and not dispersed next to each other in a matrix. The antistatic effect of the antistatic multifilament yarn 5 is caused by the special structure of the individual filaments 12, which each comprise a conductive fiber core 13 that is sheathed with a non-conductive plastic sheath 14. Similarly, the antistatic effect of the antistatic monofilament is caused by its special structure that again comprises a conductive fiber core sheathed with a non-conductive plastic sheath. The structure with a fiber core and a plastic sheath described below is usable for the individual filaments 12 of the antistatic multifilament yarn 5 as well as the antistatic monofilament.

The preferred structure of the individual filaments 12 or the monofilament is described in U.S. Pat. No. 5,202,185, the content of which is herewith incorporated by reference into this application. The individual filaments 12 or the monofilament can, however, also be structured as described in U.S. Pat. No. 3,803,453 A, the content of which is also incorporated by reference in this application.

The non-conductive plastic sheath 14 of the individual filaments 12 or the monofilaments is preferably an extrudable, synthetic, thermoplastic, fiber-forming polymer or copolymer. These include, among others, polyolefins such as polyethylene and polypropylene, polyacryls, polyamides and polyesters with a fiber-forming molecular weight. Particularly suitable sheath polymers are polyhexamethylene adipamide, polycaprolactam and polyethylene terephthalate. In general, however, other materials may also be used.

The fiber core 13 of the individual filaments 12 or the monofilaments comprises an electrically conductive material (i.e., with an ohmic resistance of $<10^6$ ohm), preferably a non-metallic material. Particularly, the fiber core 13 comprises electrically conductive carbon black, also referred to as ECCB, in order to achieve the antistatic effect. In general, however, the fiber core 13 could also comprise a different material that provides the fiber core with electrically conductive properties. The electrically conductive material is usually dispersed in a polymeric thermoplastic matrix. Thereby, particularly thin diameters of the individual filaments 12 or the monofilaments can be achieved, the handling (e.g., flexibility) of which is comparable to classic textile fibers, which would, for example, not be possible if the fiber core 13 was a solid metal core.

When carbon black is used as electrically conductive material, the carbon black concentrations used in the fiber core 13 can amount to 15 to 50 percent. Preferably, a concentration of 20 to 35 percent is used, since this provides high conductivity, while an appropriate degree of processability is maintained. The polymer in the fiber core 13 can be selected from the same group as the one for the plastic sheath, or it can be non-fiber-forming, since it is protected by the plastic sheath. In general, other materials can also be used.

The cross-section of the fiber core 13 in the individual filaments 12 or in the monofilament should be sufficient to achieve the desired antistatic effect. The proportion of the fiber core 13 in the individual fiber 12 or monofilament can, for example, be at least 0.3 vol %, preferably at least 0.5 vol %, and up to 35 vol %.

The conductive fiber core 13 has a multilobal shape in cross-section with generally at least 3, preferably 3 to 6 lobes. Preferably, each lobe has a L/D rate of 1 to 20, wherein L is the length of a line running from the center of the connection between the two lowest points of neighboring valleys on both sides of the lobe to the furthest point of this lobe. D is the largest width of the lobe, measured orthogonally to L. Alternatively, the conductive fiber core 13 could also have a different cross-sectional shape such as a circular or oval shape. In other variations, the cross-section could also be I-shaped, triangular or square.

The individual filaments 12 that can be used for the present invention have, for example, a titer of 6.5 dtex so that an antistatic multifilament yarn 5 with 24 individual filaments 12 have a titer of 156 dtex. Similarly, the monofilaments can have a titer of 156 dtex, wherein, however, the titer could also be chosen to be substantially lower or higher.

Since the rope 3 described herein is a cover-core-rope, it is possible to specifically work the antistatic multifilament yarn 5 or the antistatic monofilament into one or more components of the cover-core-rope, i.e., into the rope core 6, the sheath 7, the intermediate sheath 8 and/or the reinforcement, as a textile subelement, i.e., as a yarn and in particular as part of a twine. It should be mentioned here that it is possible that at least one antistatic multifilament yarn 5 as well as at least one antistatic monofilament can be present in the rope 3. For example, there may be only antistatic multifilament yarns 5 in the sheath 7, and there may be antistatic monofilaments in the intermediate sheath 8. Alternatively, for example, there may be antistatic multifilament yarns 5 as well as antistatic monofilaments in the sheath 7. In a further alternative variation it may be provided that there is no mixture and that only antistatic multifilament yarns 5 or only antistatic monofilaments are present in the rope 3 for inducing the antistatic effect.

Furthermore, the antistatic multifilament yarn 5 and/or the antistatic monofilament can also be worked only into the rope core 6, only into the sheath 7, only into the intermediate sheath 8, and/or only into the reinforcement, without having antistatic multifilament yarns 5 or antistatic monofilaments in the other components. In a further variation, there are no antistatic multifilament yarns 5 or antistatic monofilaments in only one, in only two or in three of the components mentioned.

This has the advantage that there is no need for excessive antistatic multifilament yarns 5 or excessive antistatic monofilaments. For example, if there is already a sufficient amount of antistatic multifilament yarn 5 in the intermediate sheath 8 to achieve the desired antistatic effect, there is no need for the addition of an antistatic multifilament yarn 5 in the rope core 6, so that, for example, more high-strength fibers can be present at the same weight. Furthermore, it is obvious that the antistatic multifilament yarns 5 are more expensive than e.g., PES fibers, so that a reduction of antistatic multifilament yarns 5 resulting in the same effect provide a cost benefit.

The selection of the amount of antistatic multifilament yarns 5 or antistatic monofilaments in the rope 3 depends on various factors that will be described in more detail below. In the simplest case, however, there is only one single antistatic multifilament yarn 5 or one single antistatic monofilament in the rope 3, which is present as a continuous fiber over the entire length of the rope 3. In particular, this may be provided with ropes 3 without strong wear.

Usually, the amount of the antistatic multifilament yarns 5 or the antistatic monofilaments in the rope 3 is selected so that either at the time of manufacture or after a certain wear of the rope, e.g., when the lifetime (i.e., replacement state) of the rope 3 according to chapter 6.3.3. of ISO TS 23624: 2021 is reached, a certain electrostatic charge is not exceeded after an electrostatic charging event (e.g., for achieving a maximum electrostatic charge of the rope). This electrostatic charge is preferably below the human detection threshold. Furthermore, this electrostatic charge can be below 8 kV, preferably below 5 kV or particularly below the human detection threshold of 3 kV or below 2 kV, measured at a temperature between 15° C. and 25° C. at a humidity between 30% and 40% at a distance of 10 cm from the rope 3.

For a more precise determination of the amount of the antistatic multifilament yarns 5 or the antistatic monofilaments in the rope 3, considerations and advantages during the arrangement of antistatic multifilament yarns 5 or antistatic monofilaments in the respective components will be explained below.

When antistatic multifilament yarns 5 or antistatic monofilaments are provided in the sheath 7, their antistatic effect is best because they are at least partially present at the outer surface of the rope 3. Thereby, the antistatic multifilament yarns 5 or the antistatic monofilaments do not have to discharge through any other fiber material.

Since during use of the rope 3 there will be damages to the sheath 7 and thus also to the antistatic multifilament yarns 5 or the antistatic monofilaments during operation, the proportion of antistatic multifilament yarns or antistatic monofilaments 5 at the sheath 7 can be increased in order to not exceed a certain electrostatic charge even after a predetermined use.

In order to select the proportion of the antistatic multifilament yarns 5 or the antistatic monofilaments in the sheath 7, the following measures may be used. Below, embodiments with antistatic multifilament yarns 5 will be explained, which may, however, also be implemented with antistatic monofilaments instead of the antistatic multifilament yarns 5. It is to be understood for the below explanations that preferably there are no antistatic monofilaments in braids, twines or yarns that do not have any antistatic multifilament yarns 5.

Figure 3:
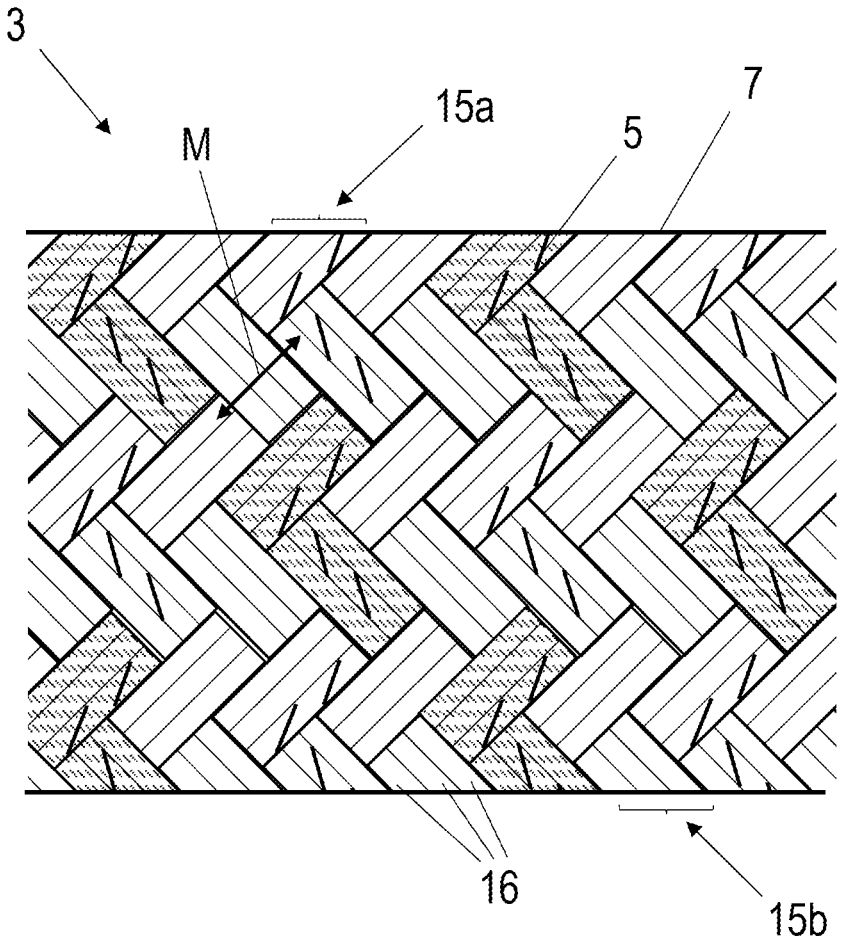
FIG. 3 shows a schematic side view of the sheath of the inventive rope in a first variation.

As shown in FIG. 3, the sheath 7 is usually a braided structure so that the sheath 7 comprises several braids 15*a*, 15*b*, wherein half of the braids 15*a* run in the so-called S direction of the sheath 7 and the other half of the braids 15*b* runs in the so-called Z direction of the sheath 7. According to the invention, it may be provided that one or more antistatic multifilament yarns 5 are only present in the braids 15*a* in the S direction, only in the braids 15*b* in the Z direction or in the braids 15*a* of the S direction as well as in the braids 15*b* of the Z direction.

When one or more antistatic multifilament yarns 5 are present in the braids 15*a* of the S direction as well as in the braids 15*b* of the Z direction, the antistatic multifilament yarns 5 form a cylindrical grid. If it is a regular cylindrical grid, the mesh width M of the grid can preferably be between 5 mm and 20 mm, particularly substantially 10 mm. This solution with a regular cylindrical grid cannot only be selected for the sheath 7, but also for the intermediate sheath 8 and/or the reinforcement if these are formed as braided structures, or also for the rope core 6 if it is implemented as a braided rope core 6.

Furthermore, it can be seen from FIG. 3 that not all braids 15*a*, 15*b* have antistatic multifilament yarns 5, but only every second braid 15*a* in the S direction and only every second braid 15*b* in the Z direction has one or more antistatic multifilament yarns 5. However, it could also be provided that all braids 15*a*, 15*b* in the S direction or the Z direction have one or more antistatic multifilament yarns 5. Alternatively it could be provided that only every third, every fourth or every fifth braid 15*a*, 15*b* in the S direction or the Z direction has one or more antistatic multifilament yarns 5. Asymmetric arrangements are also possible so that every second braid 15*a* in the S direction and every third braid 15*b* in the Z direction has one or more antistatic multifilament yarns 5. In general, it could be provided that the antistatic multifilament yarns 5 are only provided in some of the braids 15*a*, 15*b* running in the S direction or Z direction. For example, all braids 15*a*, 15*b* except one braid can comprise antistatic multifilament yarns 5.

Furthermore, it can be seen from FIG. 3 that the braids 15*a*, 15*b* have several twines 16, in this case three different twines 16 per braid 15*a*, 15*b*. In practice, such a sheath 7 with several twines 16 per braid 15*a*, 15*b* is manufactured by providing several twines 16 on the bobbins of a round braiding machine. Depending on the desired structure of the sheath 7, however, it may be provided that the braids 15*a*, 15*b* each comprise only one twine 16, only two twines 16 or more than two twines 16. As an alternative to twines 16, plied yarns may be provided. The exemplary embodiments below are all explained with twines, however, it is to be understood that plied yarns may alternatively be used.

Returning to FIG. 3, it may be seen that not every twine 16 of a braid 15*a*, 15*b* comprises an antistatic multifilament yarn 5. In the exemplary embodiment shown the braids 15*a*, 15*b* each comprise three twines 16, of which only one comprises antistatic multifilament yarns 5. In general, no or all twines 16 of a braid 15*a*, 15*b* may comprise an antistatic multifilament yarn 5, or all except one or all except two or only one, only two or only three of the twines of a braid 15*a*, 15*b* may comprise an antistatic multifilament yarn 5, depending on the number of twines per braid 15*a*, 15*b*. It can be freely selected whether the twine 16 is arranged together with the antistatic multifilament yarn 5 in the middle of the twines 16 or at the edge of the braid.

The proportion of antistatic multifilament yarns 5 in the sheath 7 can further be influenced by selecting the proportion of antistatic multifilament yarns 5 in the respective twine 16. In the simplest case, a twine 16 of a braid 15*a*, 15*b* consists of only one or more antistatic plied or twisted multifilament yarns 5. However, from the embodiment shown in FIG. 3 it can be seen that the antistatic multifilament yarn 5 can also be twisted with a different yarn or twine in order to specifically select the proportion of antistatic multifilament yarn 5. In particular, one, two, three or more than three antistatic multifilament yarns 5 can be twisted with one or more twines of high-strength materials such as p-aramid fibers, m-aramid fibers, LCP fibers, UHMWPE fibers or PBO fibers or one or more twines of non-high-strength materials such as PA fibers, PES fibers or PP fibers. For example, in practical experiments, which will be explained in more detail below, two antistatic multifilament yarns 5, each comprising twenty-four individual filaments, were twisted with a twine of UHMWPE, wherein the titer of the UHMWPE twines was more than ten times higher than the titer of the two antistatic multifilament yarns 5.

Furthermore, it can be seen from FIG. 3 that some twines 16 are shown with hatching and some of the twines 16 without hatching. Those twines 16 shown with hatching are, for example, made of non-high-strength PES fibers, and those twines 16 shown without hatching are, for example, made of high-strength UHMWPE fibers. Such a structure is especially common with crane ropes. It can be further seen that antistatic multifilament yarns 5 are twisted with PES twines in one of the braids 15*a*, 15*b*, and in another one of the braids 15*a*, 15*b* with UHMWPE twines.

Consequently, in can be generally provided that the sheath 7 may comprise high-strength fibers, preferably p-aramid fibers, m-aramid fibers, LCP fibers, UHMWPE fibers or PBO fibers, as well as non-high-strength fibers, preferably PA fibers, PES fibers or PP fibers, wherein preferably at least one first antistatic multifilament yarn 5 is twisted into a first twine with the high-strength fibers, and at least one second antistatic multifilament yarn 5 is twisted into a second twine with the non-high-strength fibers. The first and the second twine are preferably present in different braids 15*a*, 15*b*. Even if the sheath 7 comprises braids 15*a*, 15*b* of different materials, as is the case in FIG. 3, it may be provided that the antistatic multifilament yarns 5 are only twisted with twines of the same material. For example, the antistatic multifilament yarns 5 in the embodiment of FIG. 3 could also be twisted only with PES twines. Furthermore, it is to be understood that the sheath 7 can also consist of twines of only one single material, of which one, some or all are twisted with antistatic multifilament yarns 5. For example, the sheath 7 can also comprise only PES fibers and the antistatic multifilament yarns 5.

Below, the structure of a first experimental rope V1 without antistatic multifilament yarns 5, a second experimental rope V2 with a first amount of antistatic multifilament yarns 5, and a third experimental rope V3 with a second amount of antistatic multifilament yarns 5 will be explained. In the second experimental rope V2, the proportion of the antistatic multifilament yarns 5 in the total titer of the sheath 7 was 1.4%. In the third experimental rope V2, the proportion of the antistatic multifilament yarns 5 in the total titer of the sheath 7 was 2.1%.

All three experimental ropes V1, V2, V3 had a three-layered twisted rope core 6 with 35 strands with an exterior diameter of 18 mm. The rope core 6 comprised no antistatic multifilament yarns 5. Furthermore, all three experimental ropes V1, V2, V3 had a sheath 7 with an exterior diameter of 21 mm, wherein sixteen braids 15*a* were arranged in an S direction and sixteen braids 15*b* in a Z direction. Among the sixteen braids 15*a*, 15*b* each, three PES twines each with 1100 dtex/4-fold/150 T/m and one UHMWPE twine with 3300 dtex/1-fold/150 T/m were manufactured, wherein this arrangement was repeated four times.

In the first experimental rope V1, no antistatic multifilament yarns 5 were twisted. In the second experimental rope V2, antistatic multifilament yarns 5 were twisted twofold, i.e., in one of the twines 16 of every second braid (alternatingly in a PES twine and a UHMWPE twine), two antistatic multifilament yarns 5 with 156 dtex each were twisted. In the third experimental rope V3, antistatic multifilament yarns 5 were twisted threefold, i.e., in one of the twines 16 of every second braid (alternatingly in a PES twine and a UHMWPE twine), three antistatic multifilament yarns 5 with 156 dtex each were twisted.

For ease of reference, a table with the structure of the three experimental ropes V1, V2, V3 described above is provided.

| | V1 | V2 | V3 |
|---|---|---|---|
| Antistatic multifilament yarns | — | 2-fold twisting | 3-fold twisting |
| Number of braids | 32 | 32 | 32 |
| 16 braids in S direction | No braid with antistatic multifilament yarn | Every second braid (i.e., 8 braids) with antistatic multifilament yarn 3 braids with PES twines; 1 braid with UHMWPE twines (repeated 4 times) | Every second braid (i.e., 8 braids) with antistatic multifilament yarn 3 braids with PES twines; 1 braid with UHMWPE twines (repeated 4 times) |
| 16 braids in Z direction | No braid with antistatic multifilament yarn | Every second braid (i.e., 8 braids) with antistatic multifilament yarn 3 braids with PES twines; 1 braid with UHMWPE twines (repeated 4 times) | Every second braid (i.e., 8 braids) with antistatic multifilament yarn 3 braids with PES twines; 1 braid with UHMWPE twines (repeated 4 times) |
| Twines without antistatic multifilament yarns | UHMWPE: 3300 dtex/1fach/ 150T/m PES: 1100 dtex/4-fold/150 T/m | UHMWPE: 3300 dtex/1-fold/ 150T/m PES: 1100 dtex/4-fold/150 T/m | UHMWPE: 3300 dtex/ 1-fold/150T/m PES: 1100 dtex/4-fold/ 150 T/m |
| Twines with antistatic multifilament yarn | — | UHMWPE 3300 dtex/1-fold + ESD 156 dtex/2-fold/ 150 T/m or PES 1100 dtex/4-fold + ESD 156 dtex/2-fold/150 T/m | UHMWPE 3300 dtex/ 1-fold + ESD 156 dtex/ 3-fold/150 T/m or PES 1100 dtex/4-fold + ESD 156 dtex/3-fold/ 150 T/m |
| Distribution | 3 twines per braid, all without antistatic multifilament yarn | 3 twines per braid: 3 twines without antistatic multifilament yarn or 2 twines without antistatic multifilament yarn + 1 twine with antistatic multifilament yarn | 3 twines per braid: 3 twines without antistatic multifilament yarn or 2 twines without antistatic multifilament yarn + 1 twine with antistatic multifilament yarn |

All three experimental ropes V1, V2, V3 were tested in order to determine their antistatic effect after different wear times. Since it is particularly relevant whether the experimental ropes V1, V2, V3 still have a sufficient antistatic effect at the end of their lifetime, the antistatic effect was determined after 800 full-load cycles, 1200 full-load cycles and 1600 full-load cycles, which corresponds to an equivalent crane use of 4 years, 6 years and 8 years, respectively, wherein the lifetime of the experimental ropes V1, V2, V3 is 8 years, determined according to chapter 6.3.3. of ISO TS 23624:2021. The measurement results were as follows:

| | % of lifetime | V1 | V2 | V3 |
|---|---|---|---|---|
| After 800 full-load cycles | 50% | >20 kV | 20-70 V | 45 V |
| After 1200 full-load cycles | 75% | >20 kV | 1.1 kV | 15-100 V |
| After 1600 full-load cycles | 100% | >20 kV | 1.3 kV | 1.8 kV |

The antistatic effect, determined via the difference of potential measured in V, was measured at a temperature between 15° C. and 25° C. at a humidity between 30% and 40% at a distance of 10 cm from the rope 3. The measuring device had a measuring range ending at 20 kV. For the electrostatic charging of the rope, five cycles without payload were conducted at the non-grounded bottom block with a load hook, these cycles being conducted equally to the full-load cycles for determining the lifetime according to chapter 6.3.3. of ISO TS 23624:2021, i.e., the same or an identically constructed bottom block was used for determining the lifetime and the electrostatic charge. This method for inducing and determining electrostatic charge can be used for all embodiments described herein.

From the results it may be seen that both experimental ropes V2, V3 had a substantially better antistatic effect compared to the experimental rope V1, which contained no antistatic multifilament yarns 5. The comparison of the results of the experimental ropes V2, V3 also shows that the third experimental rope V3 has a substantially better antistatic effect at 1200 full-load cycles. It is therefore particularly preferred if the proportion of the antistatic multifilament yarns 5 or the proportion of the antistatic monofilaments in the total titer of the sheath 7 is at least 2.1% or substantially 2.1% in order to still achieve an excellent antistatic effect in a rope 3 until a time shortly before the end of the lifetime. Extrapolating these results it is further preferred if the proportion of the antistatic multifilament yarns 5 or the proportion of the antistatic monofilaments in the total titer of the sheath 7 is at least 3% or substantially 3% in order to still achieve an excellent antistatic effect in a rope 3 with a lifetime of 8 years when reaching the end of the lifetime.

However, it is to be understood that the invention can also be used for ropes 3 that have substantially shorter service lives or are subject to less load in other fields of application. In these cases, the proportion of the antistatic multifilament yarns 5 or the proportion of the antistatic monofilaments in the total titer of the sheath 7 can be selected substantially lower than mentioned above. In general, it is therefore preferred that the proportion of the antistatic multifilament yarns 5 or the proportion of the antistatic monofilaments in the total titer of the sheath 7 is between 0.1% and 25%, preferably between 0.2% and 10%, especially between 0.5% and 5%. In one example it may also be provided that only one single antistatic multifilament yarn 5 or one single antistatic monofilament with one single twine 16 of a single braid 15*a*, 15*b* is twisted or provided instead of this twine 16, irrespective of the actual structure of the sheath 7.

Usually, the intermediate sheath 8 optionally provided between the rope core 6 and the sheath 7 is also a braided structure and can therefore have a braid structure as described above for the sheath 7. Therefore, it may be provided that—instead of or in addition to the antistatic multifilament yarn 5 in the sheath—at least one antistatic multifilament yarn 5 or at least one antistatic monofilament is provided in the structure described above for the sheath 7 (i.e., the braid structure with braids, twines and antistatic multifilament yarns 5 twisted with these) in the intermediate sheath 8. When selecting the proportion of the antistatic multifilament yarn 5 or the proportion of the antistatic monofilaments in the total titer of the intermediate sheath 8 it is to be considered that the antistatic multifilament yarns 5 or the antistatic monofilaments have to achieve their antistatic effect through the sheath 7, and that at the same time wear of the intermediate sheath 8 plays a minor role because of the protective effect of the sheath 7. In general, however, it is preferred that the proportion of the antistatic multifilament yarns 5 or the proportion of the antistatic monofilaments in the total titer of the intermediate sheath 8 is between 0.1% and 25%, preferably between 0.2% and 10%, especially between 0.5% and 5%. In one example it may also be provided that only one single antistatic multifilament yarn 5 or one single antistatic monofilament is twisted with one single twine of one single braid of the intermediate sheath 8 or provided instead of this twine, irrespective of the actual structure of the intermediate sheath 8.

When one or more antistatic multifilament yarns 5 or antistatic monofilaments are to be present in the reinforcement, the proportion of the antistatic multifilament yarns 5 or the proportion of the antistatic monofilaments in the total titer of the reinforcement can also be selected higher than described above for the sheath 7 or the intermediate sheath 8 because the reinforcement is formed in a non-covering way. In the simplest case, the proportion of the antistatic multifilament yarns 5 or the antistatic monofilaments in the total titer of the reinforcement is 100%, i.e., the reinforcement consists only of the antistatic multifilament yarns 5 or antistatic monofilaments. It could also be provided that the reinforcement consists only of high-strength or non-high-strength twines that were twisted with the antistatic multifilament yarns 5. The reinforcement can be implemented as a grid that, for example, has a mesh width between 5 mm and 20 mm, especially of substantially 10 mm. However, the reinforcement could also be formed by stationary threads that are substantially parallel with the rope direction.

As mentioned above, however, one or more antistatic multifilament yarns 5 or antistatic monofilaments can also be present in the rope core 6. When the rope core 6 is multilayered, as for example shown in FIG. 2, it is preferred that the at least one antistatic multifilament yarn 5 or the at least one antistatic monofilament is present only in the outermost core layer 11. Thus, the antistatic multifilament yarn 5 or the antistatic monofilament is as close to the rope surface as possible. This effect can be further increased by selecting a thin sheath 7. In the field of application of rope cranes, the rope core 6 is usually formed in a high-strength manner and thus preferably consists of p-aramid fibers, m-aramid fibers, LCP fibers, UHMWPE fibers or PBO fibers, optionally with the addition of the antistatic multifilament yarns 5 or antistatic monofilaments. The rope core could, however, also consist of or comprise non-high-strength fibers.

According to the above description of FIG. 3, the sheath 7 consists of only one single covering sheath layer in which the antistatic multifilament yarn 5 or the antistatic monofilament is present.

Figure 4A:
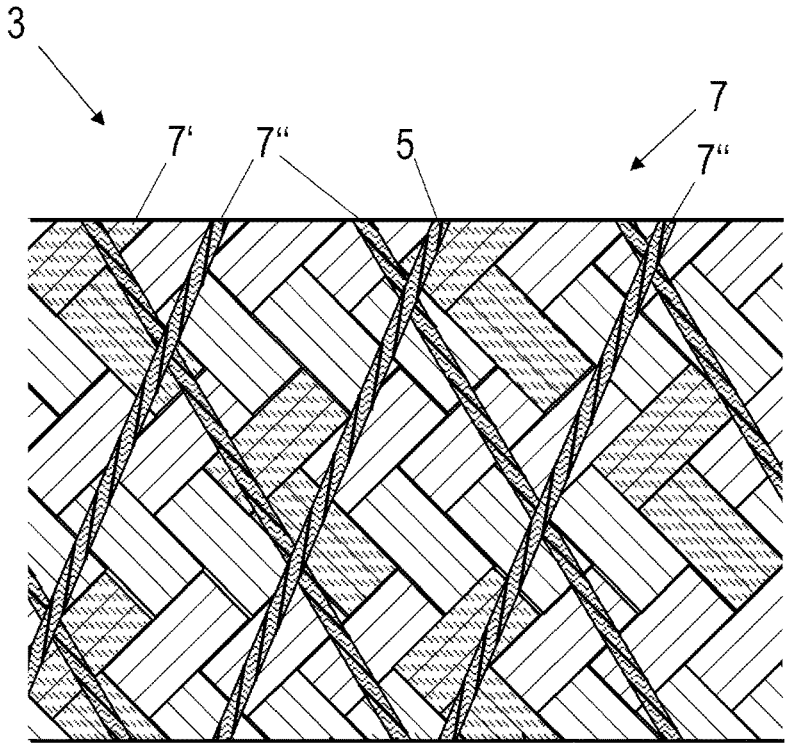
FIG. 4*a* shows a schematic side view of the sheath of the inventive rope in a second variation.
Figure 4B:
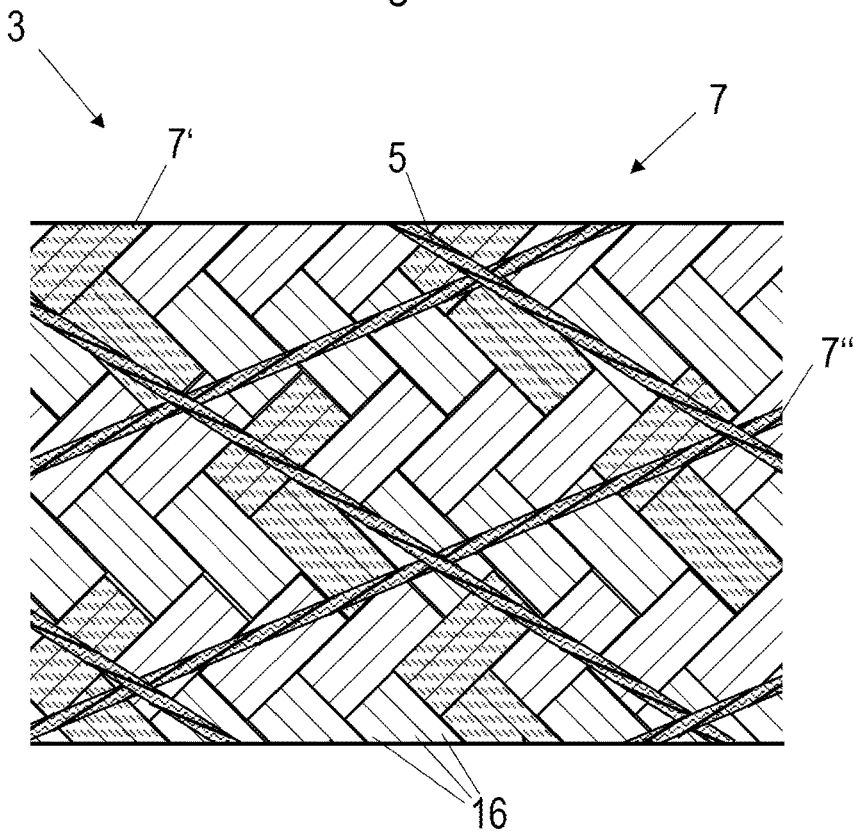
FIG. 4*b* shows a schematic side view of the sheath of the inventive rope in a third variation.

FIGS. 4*a* and 4*b* show further variations of the sheath 7 of the inventive ropes where the sheath 7 is constructed by a fully covering sheath layer 7' and a reinforcement 7" surrounding the sheath layer 7'. The covering sheath layer 7' can be implemented like the sheath 7 from FIG. 3, wherein the antistatic multifilament yarn 5 or the antistatic monofilament can be omitted or substituted by a different yarn. The non-covering reinforcement 7" of the sheath 7 can be implemented like the optional reinforcement described above between the sheath 7 and the rope core 6. In particular, the reinforcement 7" can comprise twines where the antistatic multifilament yarn 5 or the antistatic monofilament is twisted with a twine 16 or yarn of a different material or exclusively consist of at least one antistatic multifilament yarn 5 or at least one antistatic monofilament.

The further elements of the rope from FIGS. 4*a* and 4*b* can be implemented as described above. In particular, the rope core 6 can be implemented as described above and optionally an intermediate sheath 8 and/or a reinforcement can be provided between the rope core and the sheath 7.

In the embodiment of the FIGS. 4*a* and 4*b*, the antistatic multifilament yarn 5 or the antistatic monofilament is preferably only present in the reinforcement 7" of the sheath 7. Alternatively, the antistatic multifilament yarn 5 or the antistatic monofilament could also be present in one of the following elements: in the rope core 6, in the optional intermediate sheath 8 between the rope core 6 and the sheath 7, in the optional reinforcement between the rope core 6 and the sheath 7 and/or in the covering sheath layer 7'.

A comparison of FIGS. 4*a* and 4*b* further shows that the braiding angle of the non-covering reinforcement 7" can be larger than (FIG. 4*a*), smaller than (FIG. 4*b*) or equal to (not shown) the braiding angle of the covering sheath layer 7'.

The invention claimed is:

1. A rope made of a textile fiber material, comprising a rope core and a sheath surrounding the rope core, wherein the rope comprises at least one antistatic multifilament yarn or antistatic monofilament, wherein the antistatic monofilament or individual filaments of the antistatic multifilament yarn each comprises a conductive fiber core sheathed with a non-conductive plastic coating, and wherein the at least one antistatic multifilament yarn or antistatic monofilament is twisted with a twine or yarn of a different material, wherein the at least one antistatic multifilament yarn or antistatic monofilament is present only in the sheath.

2. The rope according to claim 1, wherein the material of the twine or yarn is ultra-high-molecular-weight polyethylene (UHMWPE) or polyester (PES).

3. The rope according to claim 1, wherein the fiber core of the antistatic monofilament or the fiber core of the individual filaments of the antistatic multifilament yarn has a multilobal shape in cross-section.

4. The rope according to claim 1, wherein the sheath is a braided structure with braids running in an S direction and a Z direction, wherein at least one braid running in the S direction comprises at least one first antistatic multifilament yarn or at least one first antistatic monofilament, and at least one braid running in the Z direction comprises at least one second antistatic multifilament yarn or second antistatic monofilament.

5. The rope according to claim 4, wherein antistatic multifilament yarns or antistatic monofilaments are provided in only some of the braids running in the S direction or the Z direction.

6. The rope according to claim 4, wherein the braids that comprise at least one antistatic multifilament yarn or at least one antistatic monofilament comprise at least two twines or plied yarns, of which only some comprise an antistatic multifilament yarn or at least one antistatic monofilament.

7. The rope according to claim 1, wherein the sheath is a braided structure with braids running in an S direction and a Z direction, wherein one or more antistatic multifilament yarns or antistatic monofilaments are present either in only one or more braids running in the S direction or in only one or more braids running in the Z direction.

8. The rope according to claim 1, wherein the proportion of the antistatic multifilament yarns or the proportion of the antistatic monofilaments in the total titer of the sheath is at least 0.5% and max 25%.

9. The rope according to claim 1, wherein the proportion of the antistatic multifilament yarns or the antistatic monofilaments in the rope is selected so that an electrostatic charge of the rope of 8 kV is not exceeded after an electrostatic charging event, measured at a temperature between 15° C. and 25° C. at a relative humidity between 30% and 40% at a distance of 10 cm from the rope.

10. The rope according to claim 1, wherein the antistatic multifilament yarns or antistatic monofilaments form a regular cylindrical grid.

11. The rope according to claim 10, wherein the mesh width of the regular cylindrical grid is between 5 mm and 20 mm.

12. The rope according to claim 1, wherein the rope core comprises high-strength fibers.

13. The rope according to claim 1, wherein the sheath comprises high-strength fibers as well as non-high-strength fibers.

14. The rope according to claim 13, wherein at least one first antistatic multifilament yarn or antistatic monofilament is twisted into a first twine with the high-strength fibers, and at least one second antistatic multifilament yarn or antistatic monofilament is twisted into a second twine with the non-high-strength fibers.

15. The rope according to claim 1, wherein the weight proportion of the antistatic multifilament yarn or antistatic monofilament in that antistatic twine that is formed by twisting the at least one antistatic multifilament yarn or antistatic monofilament with the twine or yarn of a different material is 3% to 20%.

16. A rope made of a textile fiber material, comprising a rope core and a sheath surrounding the rope core, wherein the rope comprises at least one antistatic multifilament yarn or antistatic monofilament, wherein the antistatic monofilament or individual filaments of the antistatic multifilament yarn each comprise a conductive fiber core sheathed with a non-conductive plastic coating, and wherein the at least one antistatic multifilament yarn or antistatic monofilament is twisted with a twine or yarn of a different material, wherein the rope further comprises an intermediate sheath located between the rope core and the sheath or a reinforcement located between the rope core and the sheath, wherein the at least one antistatic multifilament yarn or antistatic monofilament is present only in the intermediate sheath or in the reinforcement, respectively.

17. The rope according to claim 16, wherein the reinforcement is manufactured exclusively from antistatic multifilament yarns or antistatic monofilaments.

18. The rope according to claim 17, wherein the antistatic multifilament yarns or antistatic monofilaments are stationary threads.

* * * * *